United States Patent [19]

Simonsen et al.

[11] Patent Number: 5,017,021

[45] Date of Patent: May 21, 1991

[54] RECLOSABLE PROFILE HAVING IMPROVED CLOSURE MEMBERS

[75] Inventors: Steve H. Simonsen; Mladomir Tomic; Wayne M. Wegner, all of Appleton, Wis.

[73] Assignee: Reynolds Consumer Products, Inc., Appleton, Wis.

[21] Appl. No.: 354,141

[22] Filed: May 19, 1989

[51] Int. Cl.[5] ..... B65D 33/16

[52] U.S. Cl. ..... 383/63

[58] Field of Search ..... 383/63, 64, 65

[56] References Cited

U.S. PATENT DOCUMENTS

| | | | |
|---|---|---|---|
| 3,198,228 | 8/1965 | Naito . | |
| 3,338,285 | 11/1964 | Jaster . | |
| 3,425,469 | 2/1969 | Ausnit | 383/65 |
| 3,565,147 | 2/1971 | Ausnit . | |
| 3,633,642 | 1/1972 | Siegel | 383/64 |
| 4,363,345 | 12/1982 | Scheibner . | |
| 4,419,159 | 12/1983 | Herrington . | |
| 4,430,070 | 2/1984 | Ausnit . | |
| 4,528,224 | 7/1985 | Ausnit | 383/63 X |
| 4,561,109 | 12/1985 | Herrington . | |
| 4,617,683 | 10/1986 | Christoff . | |
| 4,629,524 | 12/1986 | Ausnit . | |
| 4,655,862 | 4/1987 | Christoff et al. . | |
| 4,731,911 | 3/1988 | Gould . | |
| 4,736,451 | 4/1988 | Ausnit | 383/65 |
| 4,791,710 | 12/1988 | Nocek et al. . | |
| 4,792,240 | 12/1988 | Ausnit | 383/63 |
| 4,796,300 | 1/1989 | Branson | 383/63 |
| 4,817,188 | 3/1989 | Van Erden . | |

FOREIGN PATENT DOCUMENTS

| | | |
|---|---|---|
| 1934615 | 1/1971 | Fed. Rep. of Germany . |
| 1187640 | 4/1970 | United Kingdom . |

*Primary Examiner*—Stephen Marcus
*Assistant Examiner*—Jes F. Pascua
*Attorney, Agent, or Firm*—Alan T. McDonald

[57] ABSTRACT

An improved closure member for a package is provided comprising first and second profile strips sealed to the package at the package opening, a male member formed on the first profile strip, a post member also formed on the first profile strip on the inboard side of the male member, a female member formed on the second profile strip and capable of mating with the male member under pressure, thereby forming a releasable closure mechanism for the package. The profile strip is secured to the package in a limited area such that all disengagement forces which act initially on the package are directed to the strip through a single path. The post member is positioned close enough to the male member to provide added resistance to the disengagement through a wedging or pivot-type interaction with a portion of the female member.

21 Claims, 2 Drawing Sheets

RECLOSABLE PROFILE HAVING IMPROVED CLOSURE MEMBERS

FIELD OF THE INVENTION

This invention relates generally to reclosable packages having profile strips sealed to the package. More particularly, the invention relates to an improved design for profile strips having reclosable elements formed thereon.

BACKGROUND OF THE INVENTION

It is well known to provide various types of packages with a reclosable profile strip or zipper for releasably securing the contents of the package. Such packages may be used to store a variety of items such as food products or other non-food hardware articles. A typical design for the reclosable mechanism of a profile strip is described in the patent to Naito, U.S. Pat. No. 3,198,228. Naito discloses occludent or interlocking means comprising a rib or male closure member and a mating groove or female closure member, formed along the inside of the open end of a package with the two members facing each other. The male and female members can be interlocked and disengaged under pressure, forming a pressure fastenable and releasable closure mechanism. Naito also discloses the provision of a pair of supporting rails attached to the male member with one post positioned on each side of the male member.

In some applications the profile strips are formed integrally with the package material while in other applications the profile strips are formed separately and sealed to the package. In either case the strips are completely attached to the package.

One common approach to the design of the interlocking closure mechanism has been to provide a device which requires different forces to disengage the mechanism depending on the origin of the force. Disengagement forces will originate from either the inboard side (package side) of the closure mechanism, such as those forces exerted by the contents of the package either at rest or from falling, tumbling or shock, or from the outboard side of the closure mechanism as would be exerted by a person attempting to get into the package. These devices are designed such that the force required to open the interlocking closure mechanism from the inboard side is greater than the force required to open the mechanism from the outboard side. Examples of such designs are disclosed in the patents to Naito U.S. Pat. No. 3,198,228 and Ausnit U.S. Pat. No. 4,736,451. It has been found that these designs lend themselves to being opened inadvertently due to the small force required to open the interlocking closure mechanism from the outboard side.

A different and less common approach to the design of the interlocking closure mechanism has been to design a device in view of the psychology of the average user. The user tends to be skeptical of an interlocking closure mechanism which can be easily opened from the outboard side because she or he fears that such a mechanism will present an insufficient resistance to a force which acts from the inboard side. Thus, interlocking closure mechanisms have been designed which require the same amount of force to disengage the mechanism from the outboard side as from the inboard side. An example of such a design is disclosed in the patent to Siegel, U.S. Pat. No. 3,633,642. It has been found that an acceptable range of interlocking forces exist which are both strong enough to contain or maintain the contents of the package and at the same time not so strong as to cause the user too much difficulty in getting into the package.

It is an object of the present invention to provide an improved design for a reclosable profile strip that is in keeping with the objectives of the later less common approach. Hence, it is an object of the present invention to provide an improved design for a profile strip which requires a single amount of force for disengagement and is less susceptible to inadvertent opening. To these ends the present invention provides a limited path for disengaging forces to act upon the profile, regardless of whether those forces originate on the outboard or inboard side. Thus there is a single minimum amount of force required to disengage the profile strips and open the package from the inboard or outboard side. Only one disengagement motion is contemplated for the profile strip and thus only one resistance to the disengagement need be provided. The invention eliminates the problem of inadvertent opening from the outboard side and is more consistent with the psychology of the user as described above. The need for only one method of resistance to disengagement simplifies the design and requires less material.

SUMMARY OF THE INVENTION

To these and other ends the invention comprises a package, first and second profile strips sealed to the package at the package opening, a male member formed on the first profile strip, a post member also formed on the first profile strip on the inboard side of the male member, a female member formed on the second profile strip and capable of mating with the male member under pressure, thereby forming a releasable closure mechanism for the package. The profile strip is secured to the package in a limited area such that all disengagement forces which act initially on the package are directed to the strip through a single path. The post member is positioned close enough to the male member to provide added resistance to the disengagement through a wedging or pivot-type interaction with a portion of the female member.

The invention and its advantages will best be understood upon consideration of the following detailed description of the invention, taken in conjunction with the accompanying drawings in which:

DETAILED DESCRIPTION OF THE INVENTION

Figure 1:
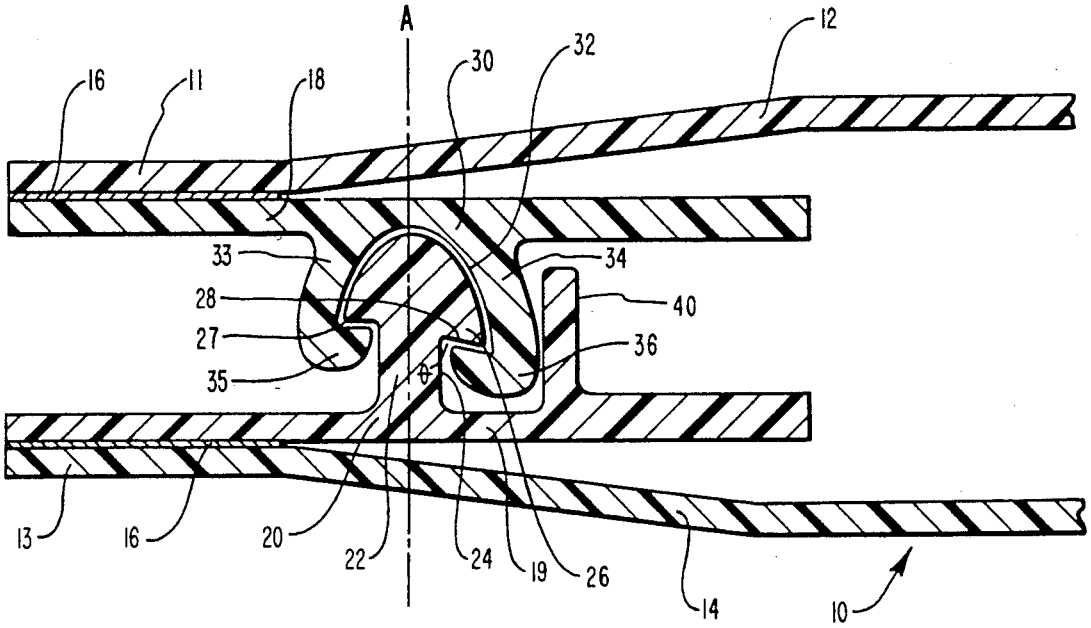
FIG. 1 is a sectional view of the mated profile strips of a preferred embodiment of the present invention.

FIG. 1 shows a package 10 having reclosable profile strips 20 and 30 embodying the present invention. The package 10 and profile strips 20 and 30 can be formed of the same material, preferably polyethylene having a density of from about 9.00 gm/cm$^2$ to about 9.60 gm/cm$^2$. A wide variety of other materials are also suitable including polypropylene and polybutylene for the package 10, and an ionomere resin from DuPont marketed under the trademark Surlyn ® for the profile strips 20 and 30, and also including various blends of the above.

The package 10 typically comprises a top film layer 12 and a bottom film layer 14. The package 10 is formed in a conventional manner by heat sealing the films 12 and 14 together around the peripheral sides (not shown). On the outboard side of the package 10, the package films 12 and 14 define flanges 11 and 13 by which the package 10 may be pulled open as demonstrated in FIGS. 2 and 3. The package 10 may be used to store a variety of food products or other non-food hardware articles. An example of a food package which can be used in conjunction with the present invention is described and illustrated in copending application, U.S. Ser. No. 07/342,257 entitled METHOD OF FORMING RECLOSABLE PACKAGES, PROFILES USED THEREIN, AND PACKAGES PRODUCED THEREBY, filed Apr. 24, 1989, incorporated by reference in its entirety.

Referring again to FIG. 1, the profile strips 20 and 30 are preferably attached to the package films 12 and 14 respectively by direct heat seal bars (not shown). Previously referenced U.S. application Ser. No. 07/342,257 discloses additional methods of attachment. Still other acceptable methods of attachment include hot air sealing, radio frequency sealing and ultrasonic heat sealing, and are all known in the art. The heat seal is applied at the intersection between web backing members 18, 19 and he package films 12, 14 respectively.

Figure 2:
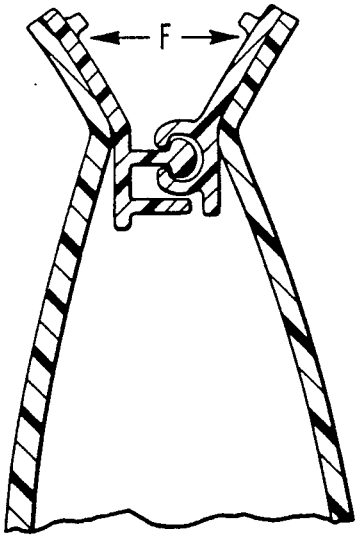
FIGS. 2 and 3 are sectional views illustrating the relative movement of the profile strips during disengagement.
Figure 3:
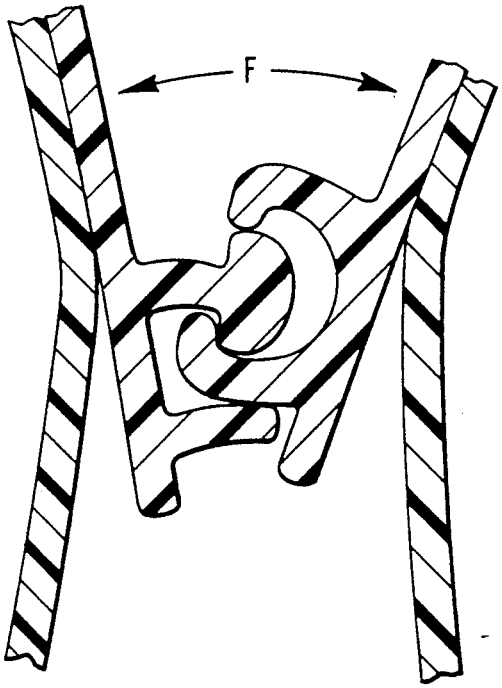
Figure 4:
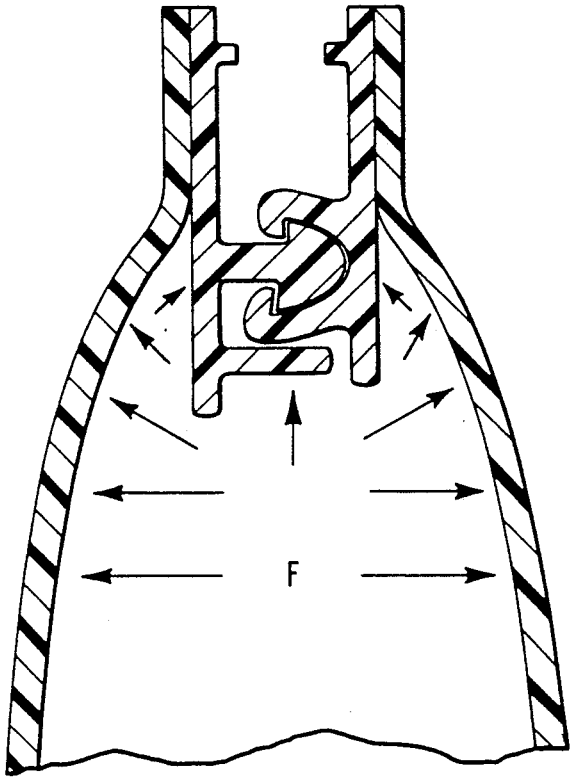
FIG. 4 is a sectional view illustrating the directions of the various forces that can originate form the inboard side of the profile strip.

As best seen in FIGS. 2–4, the web backing members 18 and 19 are not completely attached to the package films 12 and 14, but instead the heat seal is applied to a limited area referred to as the profile skirt 16. The profile skirt 16 is generally located on the outboard side of the profile strips 20, 30, either at the closure members 22 and 32 or above. The interaction between the positioning of the profile skirt 16 and the disengagement operation of the profile strips 20 and 30 will be described in more detail below.

The profile strips 20 and 30, include web backing members 18 and 19, male closure member 22, female closure member 32 and at least one post member 40 attached to profile strip 20 and located on the inboard side of the profile strip 20. A preferred configuration for the interlocking male and female closure members 22 and 32, is described and illustrated in the previously referenced patent to Naito, U.S. Pat. No. 3,198,228, also incorporated by reference in its entirety.

The cross-section of male member 22, as seen in FIGS. 1–5, is generally in the shape of an arrowhead. The male member 22 extends along the entire length of profile strip 20 and comprises a neck 24 and a head 26 having undercut portions referred to as shoulder elements 27 and 28. Shoulder element 28 is located generally closer to the male web backing 18 than is shoulder element 27. Shoulder element 28 generally angles downward toward the web backing 18 and forms an angle theta with the axis A. Shoulder element 27 is generally perpendicular to the axis A.

Female member 32 extends along the entire length of profile strip 30 and comprises a pair of stems 33 and 34 and hook members 35 and 36, with the combination generally conforming to the arrowhead shape of male member 22. Hook member 34 is located generally closer to female web backing 19 than is hook member 36. Hook member 36 angles upward in the direction of web backing 19, forming an angle alpha (not shown) with the axis A. The post 40 is generally rectangular in cross-section and extends along the entire length of profile strip 20. The post 40 is located on the inboard side of male member 22 and is generally close enough to male member 22 to engage stem 34 and hook 36 in the space between the post 40 and male member 22 when the profile strips 20 and 30 are engaged as described herein and below.

The engagement of the male member 22, female member 32 and post 40 of profile strips 20 and 30 is best seen in FIG. 1. The male member 22 and female member 32 are pressed with fingers from the exterior of the package 10 whereupon the head 26 of male member 22 comes into contact with hooks 35 and 36 of female member 32. In response to the pressure exerted by the head 26, the stems 33 and 34 and hook members 35 and 36 are forced open in the outward direction to accept the male member 22. As stem 34 and hook 36 are forced outward they strike post 40 forcing the post 40 outward in the same direction. The male member 22 advances until the stems 33 and 34 return to their original position (parallel to the axis A), and shoulders 27 and 28 are caught by the hooks 35 and 36 respectively. As stem 34 returns to its original position so does post 40 (also parallel to axis A), thereby engaging stem 34 and hook 36 in the space between male member 22 and post 40.

The forces (designated in FIGS. 2–4 as F) that operate to disengage the profile strips 20 and 30 will originate from either the outboard side, as best seen in FIGS. 2 and 3, or the inboard side as best seen in FIG. 4. From the inboard side, the forces are those that would be applied to the package films 12 and 14 by the contents of the package 10. From the outboard side, the forces are those that would be applied by a consumer attempting to open the package from the outside by pulling flanges 11 and 13. As described earlier herein, the seal between the profile strips 20 and 30 and the package films 12 and 14 is concentrated in the area referred to as the profile skirt 16, and is located on the outboard side of the profile strips 20 and 30, either at the closure members 22 and 32 or above. As a result of the location of profile skirt 16, the disengagement forces described above are translated to the profile strips 20 and 30 via the profile skirt 16, regardless of whether the forces originate from the inboard side (package content generated) or the outboard side (consumer generated). Thus there is only one path for disengagement forces to be applied to the profile strips, and therefore there is needed only one method of resistance to those forces.

FIGS. 2 and 3 illustrate the relative movement of male member 22, female member 32 and post 40 during disengagement of the profile strips 20 and 30. As disengagement forces are applied via profile skirt 16, the profile strips 20 and 30 are pulled in opposite directions and the male and female members 22 and 32 begin to angle away from each other. Hook 35 will move along shoulder 27 until disengaged. Meanwhile, hook 36 will move along shoulder 28 in a direction away from male member 22. The angled orientations of shoulder 28 and hook 36 interact to resist the movement of hook 36 along the shoulder 28. The position of post 40 is such that the stem 34 and hook 36 will strike post 40 as the hook 36 continues to travel along shoulder 28. The post 40 will bend outward in response to the pressure from the stem 34 and hook 36 creating a wedge or pivot-type interaction between the post 40, stem 34, hook 36, and male member 22 thereby providing further resistance to disengagement. As continued force is applied via profile skirt 16, hook 36 will continue to move along shoulder 28 until disengaged, completing the separation of profile strips 20 and 30 and opening the package 10.

As is evident from the above description of the operation of the present invention, the relative dimensions, orientations and positioning of the various components of the profile strips 20 and 30 will affect the interlocking strength (resistance to disengagement) and efficient operation of the device. In the preferred embodiment the width of stems 33 and 34 is 0.01" each. The distance from the outer edge of female web backing 19 to the end of hook 35 is from about 0.045" to about 0.050". The width of neck 24 is about 0 015". The angle theta is about 75 degrees and the distance from the outer edge of male web backing 18 to the top of head 26 is from about 0.045" to about 0.050". The clearance between stems 34 and 35 should generally be in the area of 0.020".

When the profile strips 20 and 30 are engaged, the post 40 should be at least as tall as the undercut portion of the hook 36 so that the stem 34 and hook 36 will sufficiently contact post 40 during disengagement. The post 40 should also be located close enough to the male member 22 provide sufficient tracking and stability for the stem 34 and hook 36 during engagement and also provide wedging or pivot-type action during disengagement as described above. In the preferred embodiment the post 40 will just touch the stem 34 when the profile strips 20 and 30 are engaged. The dimensions described for the preferred embodiment described herein yields a profile with a disengagement force of from about 1 and ½ lbs. to about 2 and ½ lbs.

The heat seal must be of sufficient strength to resist separating or breaking under the strain of the various forces that are routinely exerted on the package 10. In particular, the seal must be at least stronger than the force required to disengage profile strips 20 and 30. The strength of the seal is related to the area of the profile skirt 16. In the preferred embodiment the profile skirt 16 extends along the length of profile strips 20 and 30 and is from about 0.004" to about 0.007" thick (measured from outboard to inboard).

Figure 5:
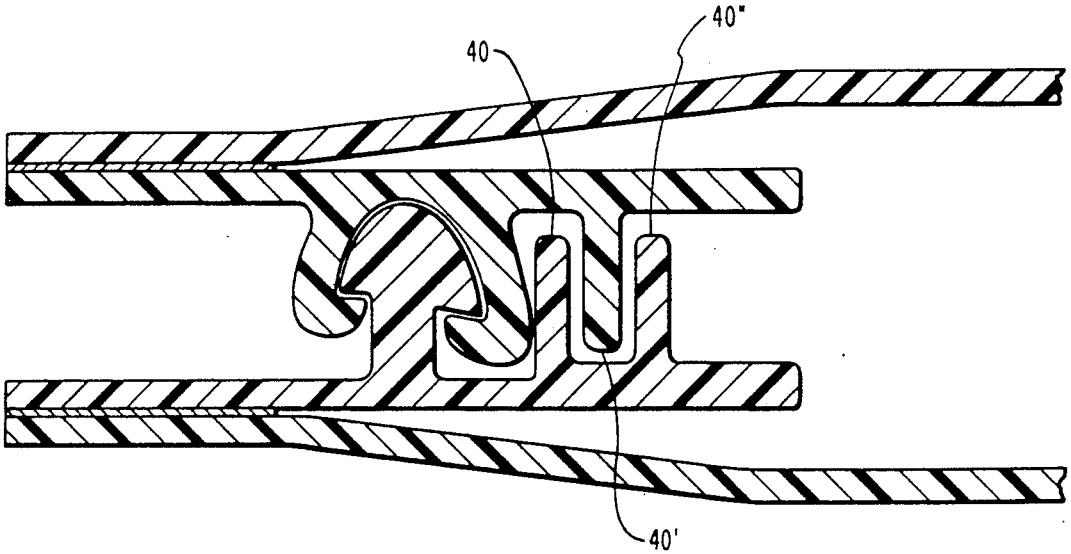
FIG. 5 is a sectional view of the mated profile strips illustrating a second preferred embodiment of the present invention.

While the above-described embodiment of the present invention is preferred, those skilled in this art will recognize modifications of structure arrangement, composition and the like which do not part from the true scope of the invention. In particular, additional posts 40' and 40" may be added to the inboard side of the present embodiment as seen in FIG. 5, thereby increasing the interlocking strength and providing additional tracking for engagement of the profiles 20 and 30. The additional posts 40' and 40" are positioned similar to the original post 40, alternating between profiles 20 and 30. The posts 40' and 40" should be positioned close enough to the adjacent post to allow contact between the posts during disengagement. In addition the angle of orientation for closure members 22 and 32 and post 40 with respect to web backing members 18 and 19 can be varied to further adjust the interlocking strength. Further still, the profiles can be integrally formed with the package material as long as the area of intersection between the profile and package is limited to the profile area in the manner described herein. All such modifications are intended to be covered by the appended claims.

We claim:

1. A profile for use in reclosable packages comprising:

a package having an open end, and a package end;

first and second profile strips attached to said package at said open end;

rib means formed on said first profile strip;

post means formed on said first profile strip and located between said rib means and said package end;

groove means formed on said second profile strip and capable of mating with said rib means under pressure, thereby closing said package;

said groove means also being capable of disengagement from said rib means due to pressure;

said first profile strip being attached to said package in a first limited area located between said rib means and said open end, and said second profile strip being attached to said package in a second limited area located between said groove means and said open end, whereby disengagement forces that originate from said package end are translated to said profile in the same manner as disengagement forces that originate from said open end; and said post means being of sufficient height and positioned close enough to said rib means to contact a portion or said groove means during disengagement prior to any contact with said second profile strip.

2. A profile for use in a reclosable package, the package being formed from a top and a bottom film layer each having top, bottom and side edges, the film layers being attached to one another around the side and bottom edges of each film thereby forming a package end, and separated from one another at the top edge of each film thereby forming an open end, the profile comprising:

first and second profile strips, each strip having a profile side and a base side, said profile sides having first and second engagement means;

post means formed on said profile side of said first profile strip and located between said first engagement means and said package end;

first attachment means for connecting said first profile strip to said top film at said open end via an upper end of said first base side in a first limited area located between said first engagement means and said open end, and second attachment means for connecting said second profile strip to said bottom film at said open end via an upper end of said second base side in a second limited area located between said second engagement means and said open end, whereby disengagement forces that originate from said package end are translated to said profile in the same manner as disengagement forces that originate from said open end; and said first and second profile sides facing each other when said first and second profile strips are in place at said open end and capable of mating under pressure, thereby closing said package.

3. The profile defined in claim 2 wherein said post means is positioned close enough to said first engagement means to contact a portion of said second engagement means during disengagement of said profile strips.

4. The profile defined in claim 3 wherein said post means is of sufficient height such that, during disengagement, said post means first contacts a portion of said second engagement means prior to any contact with said second profile strip.

5. The profile defined in claim 2 wherein said first engagement means includes a multi-hook rib element and said second engagement means includes a complementary groove element.

6. The profile defined in claim 2 wherein said second engagement means includes a multi-hook rib element and said first engagement means includes a complementary groove element.

7. A profile for use in a reclosable package, the package being formed from a top and a bottom film layer each having top, bottom and side edges, the film layers being attached to one another around the side and bottom edges of each film thereby forming a package end, and separate from one another at the tope edge of each film thereby forming an open end, the profile comprising:

first and second profile strips, each strip having a profile side and a base side, said profile sides having first and second engagement means;

a plurality of post means formed on said profile sides of said first and second profile strips and located between said first engagement means and said package end on said first profile strip and between said second engagement means and said package end on said second profile strip;

first attachment means for connecting said first profile strip to said top film at said open end via an upper end of said first base side in a first limited area located between said first engagement means and said open end;

second attachment means for connecting said profile strip to said bottom film at said open end via an upper end of said second base side in a second limited area located between said second engagement means and said open end; and said first and second profile sides facing each other when said first and second profile strips are in place at said open end and capable of mating under pressure, thereby closing said package.

8. The profile defined in claim 7 wherein one of said plurality of post means is positioned immediately adjacent to said first engagement means on said first profile strip and also close enough to said first engagement means to contact a portion of said second engagement means during disengagement of said profile strips.

9. The profile defined in claim 8 wherein each of said plurality of post means is positioned close enough to the adjacent post means to allow contact between said post means during disengagement of said profile strips.

10. The profile defined in claim 9 wherein said plurality of post means alternate between said first and second profile strips.

11. A profile for use in a reclosable package, the package being formed from a top and a bottom film layer each having top, bottom and side edges, the film layers being attached to one another around the side and bottom edges of each film thereby forming a package end, and separated from one another at the top edge of each film thereby forming an open end, the profile comprising:

first and second profile strips, each strip having a profile side and a base side, said profile sides having first and second engagement means;

post means formed on said profile side of said first profile strip and located between said first engagement means and said package end;

said first profile strip being integral with said top film via an upper end of said first base side in a first limited area located between said first engagement means and said open end, and said second profile strip being integral with said bottom film via an upper end of said second base side in a second limited area located between said second engagement means and said open end, whereby disengagement forces that originate from said package end are translated to said profile in the same manner as disengagement forces that originate from said open end; and said first and second profile sides facing each other when said first and second profile strips are in place at said open end and capable of mating under pressure, thereby closing said package.

12. The profile defined in claim 11 wherein said post means is positioned close enough to said first engagement means to contact a portion of said second engagement means during disengagement of said profile strips.

13. The profile defined in claim 12 wherein said one of said post means is of sufficient height such that, during disengagement, said post means first contacts a portion of said second engagement means prior to any contact with said second profile strip.

14. The profile defined in claim 11 wherein said first engagement means includes a multi-hook rib element and said second engagement means includes a complementary groove element.

15. The profile defined in claim 11 wherein said second engagement means includes a multi-hood rib element and said first engagement means includes a complementary groove element.

16. A profile for use in a reclosable package, the package being formed from a top and a bottom film layer each having top, bottom and side edges, the film layers being attached to one another around the side and bottom edges of each film thereby forming a package end, and separate from one another at the tope edge of each film thereby forming an open end, the profile comprising:

first and second profile strips, each strip having a profile side and a base side, said profile sides having first and second engagement means;

a plurality of post means formed on said profile sides of said first and second profile strips and located between said first engagement means and said package end and between said second engagement means and said package end;

said first profile strip being integral with said top film via an upper end of said first base side in a first limited area located between said first engagement means and said open end;

said second profile strip being integral with said bottom film via an upper end of said second base side in a second limited area located between said second engagement means and said open end; and said first and second profile sides facing each other when said first and second profile strips are in place at said open end of said package and capable of mating under pressure, thereby closing said package.

17. The profile defined in claim 16 wherein one of said plurality of post means is positioned immediately adjacent to said first engagement means on said first profile strip and also close enough to said first engagement means to contact a portion of said second engagement means during disengagement of said profile strips.

18. The profile defined in claim 17 wherein each of said plurality of post means is positioned close enough to the adjacent post means to allow contact between said post means during disengagement.

19. The profile defined in claim 18 wherein each of said plurality of post means alternate between said first and second profile strips.

20. The profile defined in claim 19 wherein said first engagement means includes a rib element and said second engagement means includes a groove element.

21. The profile defined in claim 19 wherein said first engagement means includes a groove element and said second engagement means includes a rib element.

* * * * *